US005752404A

United States Patent [19]

White et al.

[11] Patent Number: 5,752,404

[45] Date of Patent: May 19, 1998

[54] ROLL SHIFTING SYSTEM FOR ROLLING MILLS

[75] Inventors: Jeffrey C. White, Allison Park; Bruce G. Ainsworth, Monroeville, both of Pa.

[73] Assignee: Tippins Incorporated, Pittsburgh, Pa.

[21] Appl. No.: 768,140

[22] Filed: Dec. 17, 1996

[51] Int. Cl.[6] ..... B21B 31/07; B21B 31/18

[52] U.S. Cl. ..... 72/247; 72/237

[58] Field of Search ..... 72/237, 238, 247, 72/245

[56] References Cited

U.S. PATENT DOCUMENTS

| | | | |
|---|---|---|---|
| 4,406,144 | 9/1983 | Bond et al. | 72/238 |
| 4,499,748 | 2/1985 | Nihei et al. | 72/238 |
| 4,736,609 | 4/1988 | Schiller et al. | 72/244 |
| 4,744,235 | 5/1988 | Schiller | 72/247 |
| 4,770,021 | 9/1988 | Kobayashi et al. | 72/247 |
| 4,773,246 | 9/1988 | Perret | 72/247 |
| 4,781,052 | 11/1988 | Schiller | 72/247 |
| 4,848,128 | 7/1989 | Bohnenkamp et al. | 72/247 |
| 4,898,014 | 2/1990 | Ginzburg et al. | 72/247 |
| 4,905,494 | 3/1990 | Frosch | 72/247 |
| 4,934,166 | 6/1990 | Giacomoni | 72/247 |

FOREIGN PATENT DOCUMENTS

| | | | |
|---|---|---|---|
| 61-52914 | 3/1986 | Japan | 72/247 |
| 5-123717 | 5/1993 | Japan | 72/247 |
| WO 8703228 | 6/1987 | WIPO | B21B 31/18 |
| WO 8808761 | 11/1988 | WIPO | B21B 31/18 |

*Primary Examiner*—Lowell A. Larson
*Assistant Examiner*—Rodney Butler
*Attorney, Agent, or Firm*—Webb Ziesenheim Bruening Logsdon Orkin & Hanson, P.C.

[57] ABSTRACT

An improved roll shifting system for rolling mills comprising a pair of work rolls positioned on each side of the rolling plane, a pair of upright frame posts defining an opening in which chock guides are mounted facing the opening and chocks on each axial end of each roll. The chock guides have upper and lower leg portions extending outwardly from the frame posts upon which box slides are mounted. Hydraulic pistons and cylinders connected between the distal end of the box slides and the distal end of each leg move the box slides, thus moving the chocks carrying the work rolls.

6 Claims, 5 Drawing Sheets

ROLL SHIFTING SYSTEM FOR ROLLING MILLS

BACKGROUND OF THE INVENTION

The present invention relates to rolling mills for producing hot and cold rolled strip. Typically, the mills have a pair of work rolls that contact the strip passing between them along a plane referred to as the rolling plane. Often, two or more pairs of backup rolls support the work rolls in a manner well understood in the art. The work rolls and sometimes the backup rolls are driven by large electric motors. Rolls have a limited service life due to the effects of the strip upon the rolls and must be changed from time to time. The entire mill is shut down during roll changing. Therefore, rolling mills are designed for rapid roll changing. To increase the service life of working rolls and to improve the profile of the strip product, it is desirable to be able to shift the working rolls axially relative to each other. Numerous patents have issued directed to roll shifting. The need for simple and effective means to perform roll shifting is clearly of paramount importance in the steel and other metals industries.

In a typical hot or cold strip mill, there are one or more roll stands spaced along the path of the strip. The strip may pass once through a roll stand or it may pass back and forth through the roll stand. Each stand is provided with two pairs of upright frame posts, one pair on each side of the path of the strip. The rolls are supported by the frame posts. Motors and connecting shafts for driving the rolls are located on one side of the stand. On the other side, provisions are made for withdrawing and replacing rolls.

Typically, on each axial end of every roll is a chock which is a structure in which the ends of the rolls are journaled, for example, by radial bearings and thrust bearings. Mounted on each frame post is a structure for receiving the chocks and permitting certain vertical and axial movement of the chocks within the stand. These structures are referred to herein as chock guides and are sometimes referred to in the industry as "Mae Wests".

It is an object, according to this invention, to provide an improved apparatus associated with the chocks and chock guides for permitting roll shifting and locking and unlocking of the chocks in a roll stand.

SUMMARY OF THE INVENTION

Briefly, according to this invention, there is provided a system for shifting rolls in a rolling mill. A pair of work rolls is, positioned with substantially parallel axes on each side of the rolling plane. The axes of the rolls are generally perpendicular to the direction of rolling. (As used herein, the "axial direction" is the direction of the axes of the work rolls when they are perpendicular to the rolling direction.) At each axial end of the rolls, a pair of upright frame posts define openings therebetween. The axial ends of the rolls are journaled in chocks by bearings, for example, radial and thrust bearings. Chock guides are interposed between the frame posts and chocks. It is an improvement, according to this invention, that the chock guides comprise a body portion attached to the frame posts and upper and lower legs extending outwardly from the body portion and frame posts in the axial direction. The legs have a rectangular cross section and a horizontal slot generally perpendicular to the axial direction. On each leg, a box slide having horizontal and vertical faces encloses the leg and is configured to slide in the axial direction of the leg. Each box slide has openings and bushings on each vertical face of the slide. Roll shifting hydraulic pistons and cylinders are mounted between an end of the box slide and the distal end of the legs to move the box slides along the legs. Locking pins pass through the slots in the legs and are slidably journaled in the bushings in each vertical face of the box slides. Each chock has a vertical slot for slidably receiving the end of a locking pin such that when the pin is seated in the vertical slots, the box slides and chocks must travel together in the axial direction but the chocks are permitted vertical movement. Hydraulic pistons and cylinders are mounted between a bracket on each box slide and the locking pins to move the pins in and out of the vertical slots in the chocks.

Preferably, the pistons and cylinders which actuate the locking pins are mounted to the brackets on the box slides with a trunnion mount. Preferably, the pistons and cylinders which actuate the locking pins are connected to the pins by a ball joint. It is a preferred embodiment, according to this invention, that the chock slides be fabricated from unitary forgings and that the forgings have bores therein for accommodating balancing/bending cylinders in the body thereof and an axial bore in each leg for accommodating the shifting cylinders.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
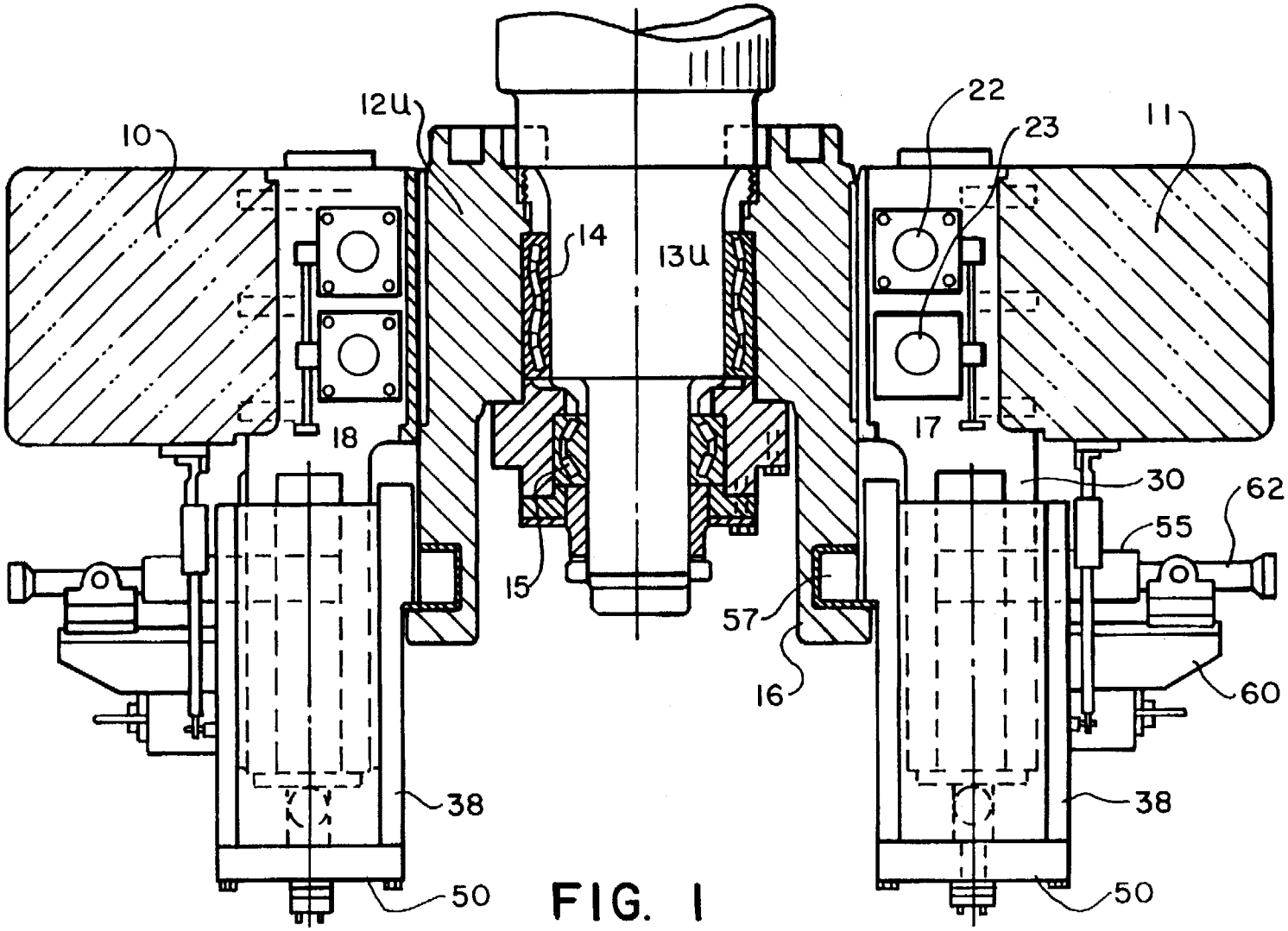
FIG. 1 is a plan view in partial section taken through the frame posts and chocks on one side of the rolling stand.

Referring to FIG. 1, the frame posts 10, 11 on the replacement side of a roll stand are shown in section. These define an opening for accepting chock guides and chocks. In FIG. 1, the chock 12U and the journaled end of the upper work roll 13U are also shown in section. Radial bearings 14 and thrust bearings 15 journal the end of the roll within the chock. The chocks have an axial extension 16 that extends out from the frame posts.

Figure 2:
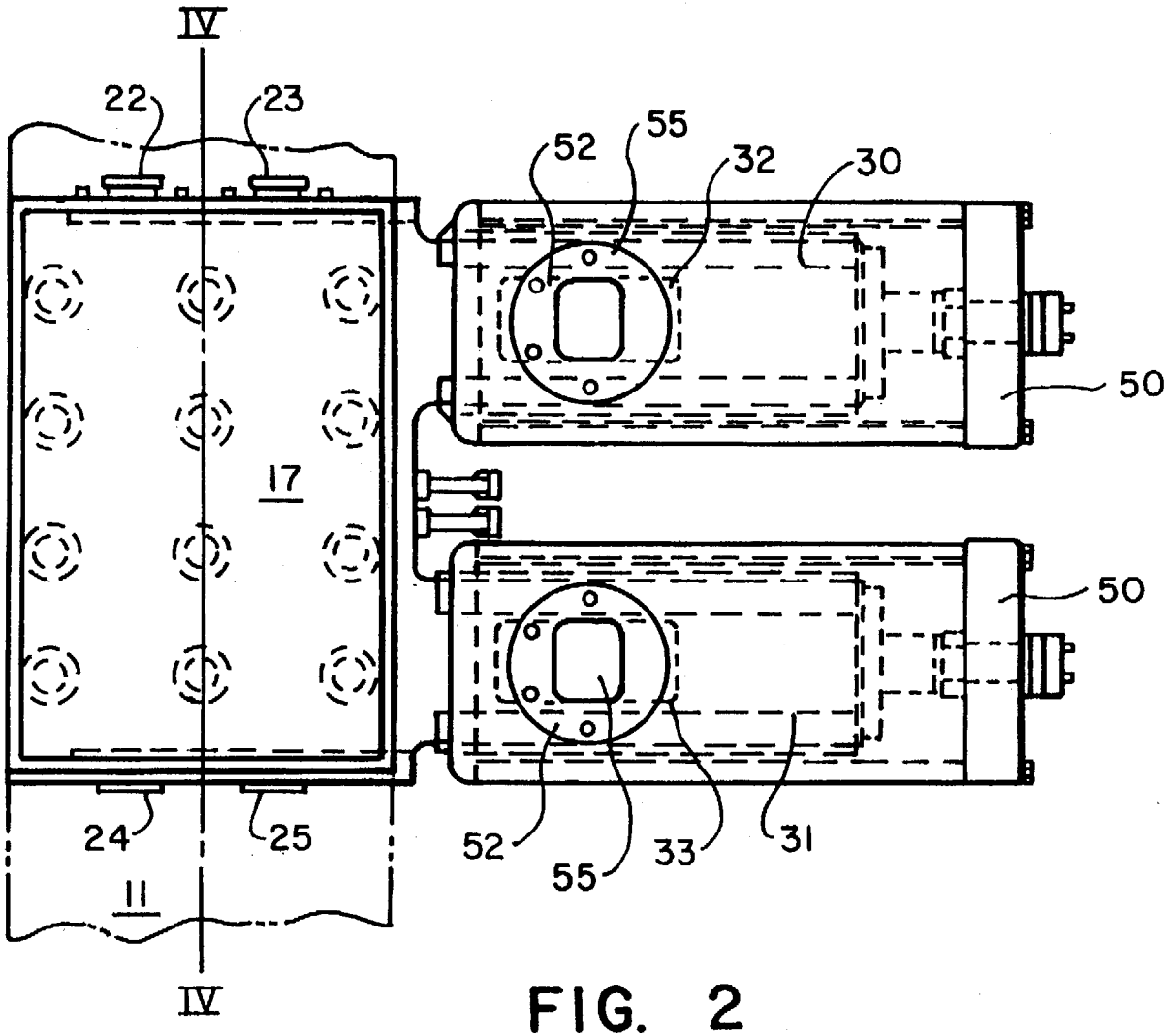
FIG. 2 is a side elevation view of a right-hand chock guide according to FIG. 1.

The right-hand and left-hand chock guides 17 and 18 are secured to frame posts 11 and 10 such that the chock guide has a sliding fit therebetween. As shown in FIG. 2, the chock guides are provided with 12 countersunk bores to enable the guides to be bolted to the frame posts. The right-hand chock guide 17 on frame post 11 is a mirror image of the left-hand chock guide 18 on the other post 10.

Figure 3:
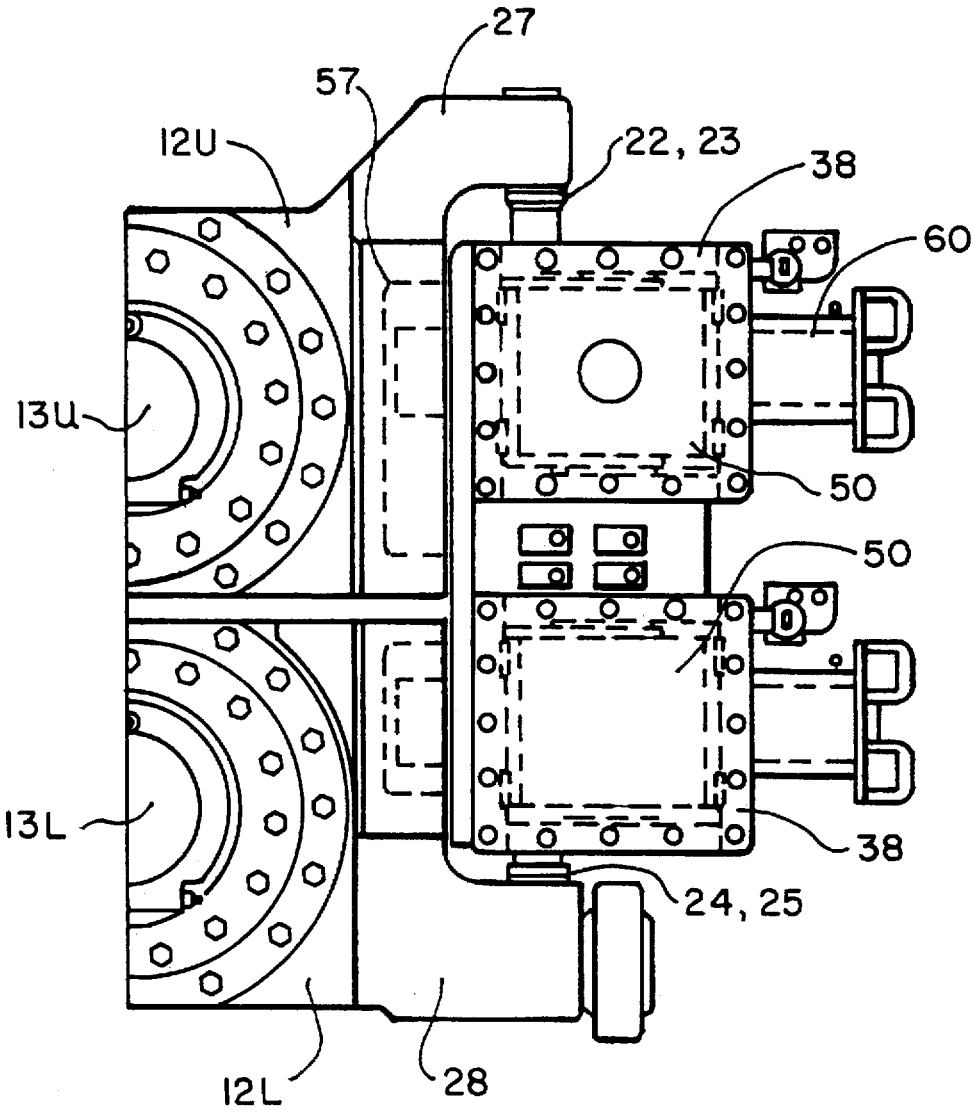
FIG. 3 is an end elevation view of a right-hand chock guide and upper and lower chocks according to this invention.

According to a preferred embodiment of this invention, the chock guides have a pair of balance/roll bending piston cylinders and pistons for top positive bending and moving of the chock supporting the upper work roll. Another pair of piston cylinders and pistons for bottom negative bending and lower chock movement support the lower work roll. Specifically, pistons 22 and 23 (see FIGS. 1, 2 and 3) engage an arm 27 extending from the chock for the upper work roll chock 13U and pistons 24, 25 engage an arm 28 integral with the lower work roll chock 13L.

Figure 4:
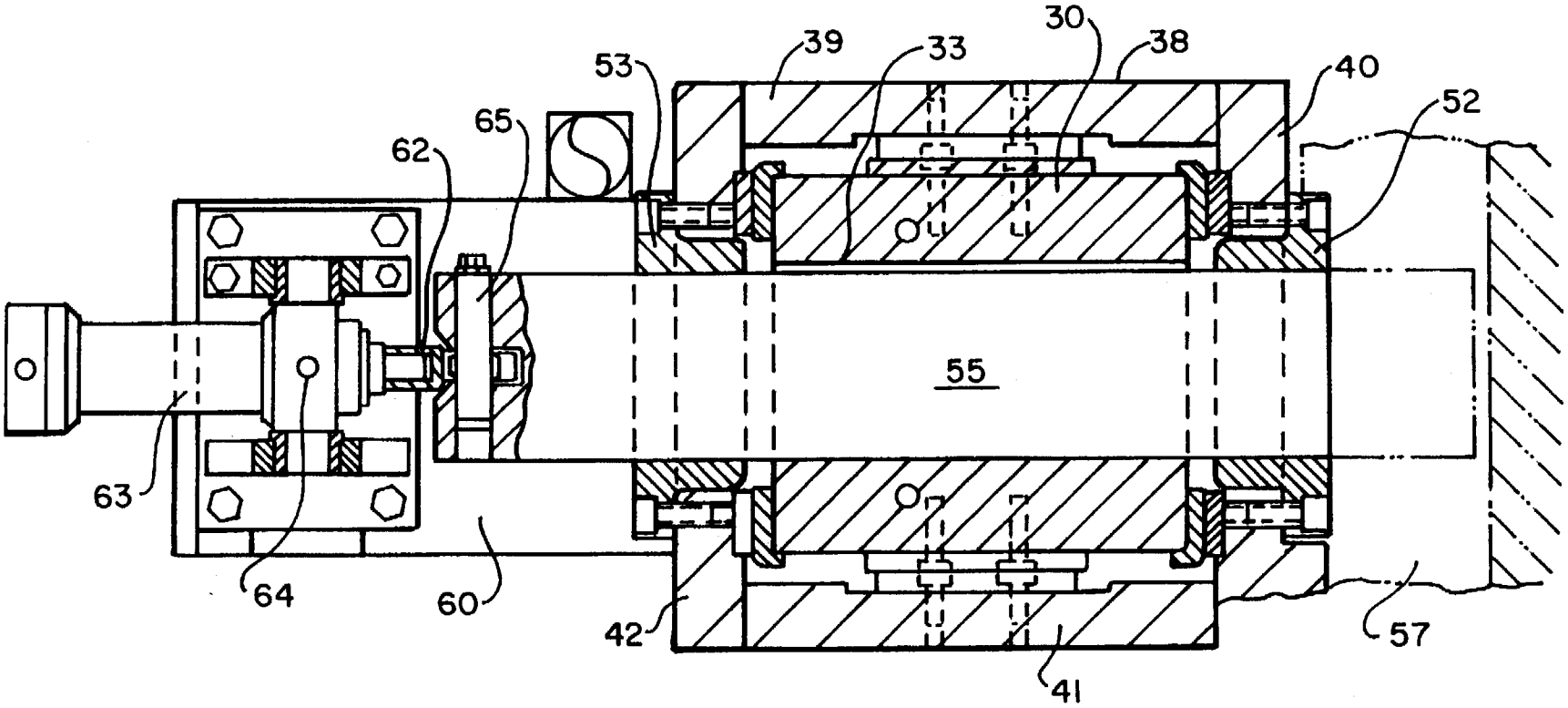
FIG. 4 is a section view of a chock guide taken along lines IV—IV of FIG. 2.
Figure 5:
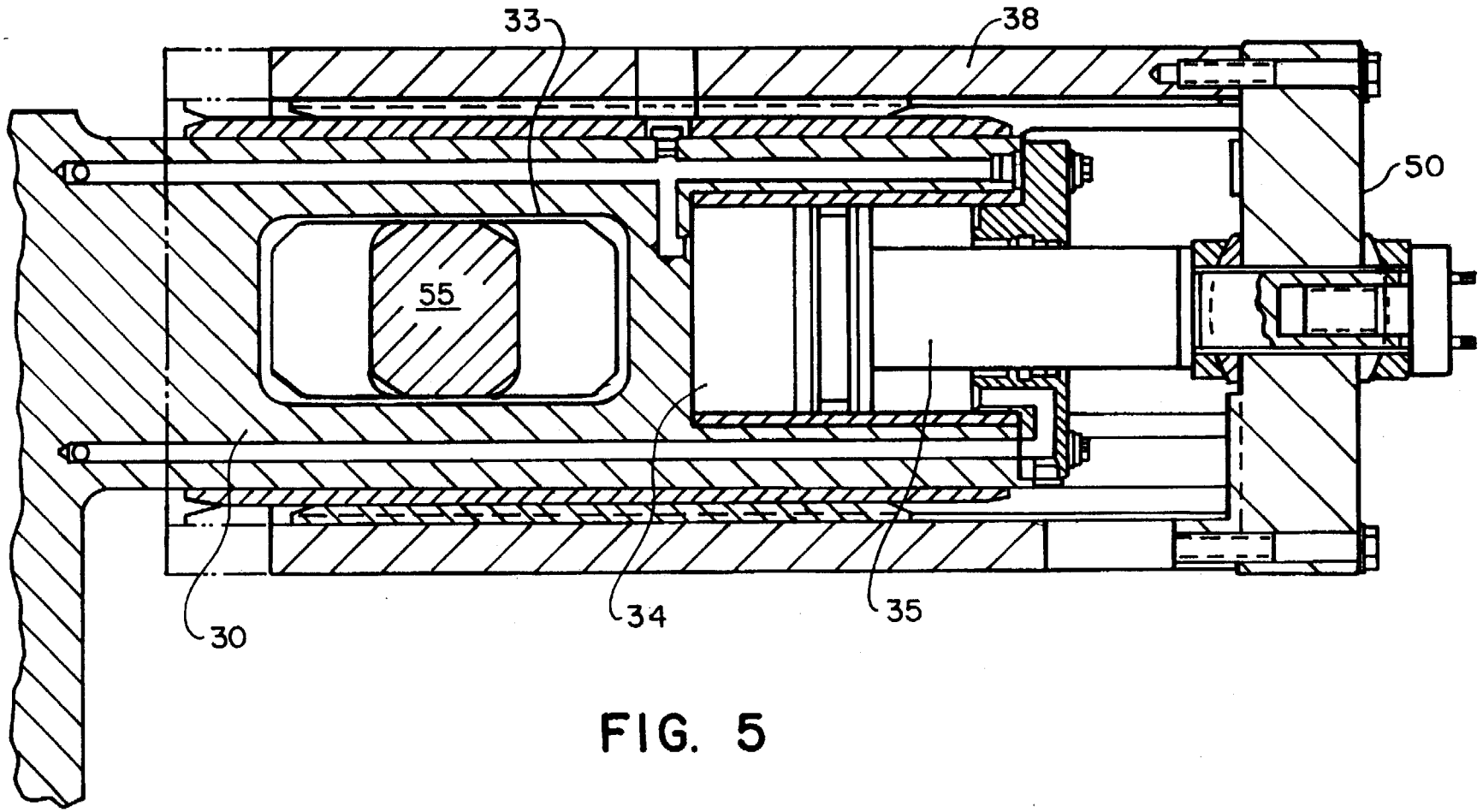
FIG. 5 is a section view of the chock guide looking perpendicular to the axis of the rolls and with the chock removed.

What has been described under this heading so far is typical of prior art rolling mill stands. Extending axially away from the rolls and the frame posts are legs 30 and 31 (see FIG. 2) which are integral with each chock guide. The legs 30 and 31 have rectangular cross sections (see FIG. 4) and a horizontal slot 33 (see FIG. 5) opening through the legs in the horizontal direction. The legs also have an axial bore 34 which serves as a cylinder or cylinder receptacle for a hydraulic piston and cylinder 35 (see FIG. 5).

Box slides 38 have four sides 39, 40, 41 and 42 (see FIG. 4) and are constructed from four plates so that the box slides slide in the axial direction over each leg extending from the body of the chock guides. The box slides have an end plate 50 bolted to the four side plates. The horizontal sides 40, 42 of the box slides have bushings 52, 53 mounted therein and bolted thereto. Piston 35 is fixed to the end plate 50. Hence, actuation of the piston will cause the box slides to move in and out over the legs 30, 31.

Locking pins 55 slide in bushings 52 and 53 so that they can be withdrawn with an end even with bushing 52 or extended beyond bushing 52 to engage a vertical slot 57 in the axial extensions 16 of the chocks. The slot 57 runs vertically so that when the locking pin 55 is engaged therein, the chocks are not restrained in the vertical direction by the locking pins but the chocks are restrained in the axial direction. Preferably, the slots 57 are lined with a composite bearing plate material.

When the hydraulic pistons 35 are actuated and the locking pins 55 are engaged in the slots 57, the chocks are carried by the box slides 38 in the axial direction for effecting roll shifting. The slots 33 in the legs 30, 31 are longer than the axial direction of the travel of the piston 35 so that the locking pins 55 never engage the legs through which they pass.

A bracket 60 extends away from the box slides. A hydraulic piston 62 and cylinder 63 are arranged for actuating the locking pin 55. The cylinder is trunnion mounted at 64 to the cylinder and the piston is attached to the locking pin through a ball joint 65. Thus, any torque applied to the locking pin is not transferred to the piston and cylinder.

When it is time to change the rolls, the piston 62 extracts the locking pin 55 from the vertical slots 57 in the chocks so that the rolls can be withdrawn from the roll stand.

It is an advantage, according to this invention, that there is a long sliding engagement between the legs 30, 31 and the box slides 38. Hence, when the pin 55 passes through the box slide 38 and engages the vertical slot 57 in the chock and the piston 35 is actuated to cause the box to slide, the torque transferred from the pin to the box slide is easily resisted without distorting the box slide.

It is also an advantage, according to this invention, that the spaced bushings 52 and 53 provide a strong assembly with a minimum of play between the locking pins 55 and the box slides that might, over time, cause distortion of the pins and box slides.

It is yet another advantage, according to this invention, that the chock guides can be forged in one large piece and then machined to provide the slots and hydraulic cylinders required therein.

Having thus described our invention with the detail and particularity required by the Patent Laws, what is desired protected by Letters Patent is set forth in the following claims.

We claim:

1. A rolling mill with axially movable rolls comprising:

a pair of work rolls positioned with substantially parallel axes perpendicular to the rolling direction on each side of a rolling plane;

at each axial end of the rolls, a pair of upright frame posts defining an opening;

on each upright post a chock guide mounted facing into the opening defined by the pair of posts;

chocks on each axial end of each roll, said rolls being journaled in said chocks;

the improvement comprising:

said chock guides comprising a body portion attached to said frame posts and attached upper and lower leg portions extending outwardly from the frame posts to which the chock guides are attached, said leg portions having a fixed length extending between the body portion and the distal ends of said leg portions, said leg portions having rectangular cross sections and horizontal slots extending through the leg portions in the rolling direction between the body portion and the distal ends of the leg portions;

on each leg portion a box slide having horizontal and vertical faces enclosing the leg portion and configured to slide in the axial direction of the work rolls, each slide having openings on each vertical face with bushings mounted therein, each box having an open end and a closed end;

roll shifter hydraulic piston and cylinder connected between the closed end of the box slide and the distal end of each leg to move the box slide along the leg;

locking pins that pass entirely through the slots in the leg portions and are slidably journaled in the bushings in both vertical faces of the box slides;

said chocks having a vertical slot for slidably receiving an end of said pin such that when the pin is seated in the vertical slots the box slide and chocks must move together in the axial direction but permit the vertical movement of the chock; and a hydraulic piston and cylinder between a bracket on each box slide and the locking pins to move said pins in and out of the vertical slot in the chocks.

2. The improvement according claim 1 in which a simple, unique and rugged device is provided to effect the axial shifting of work rolls in the rolling mill, wherein the piston and cylinders between the brackets on the box slides and the locking pins are trunnion mounted.

3. The improvement according to claim 1 in which a simple, unique and rugged device is provided to effect the axial shifting of work rolls in the rolling mill, wherein the piston and cylinders between the brackets on the box slides are connected to the pins by a ball joint.

4. The improvement according to claim 1 in which a simple, unique and rugged device is provided to effect the axial shifting of work rolls in the rolling mill, wherein the roll shifting cylinders are defined by axial bores in each distal end of each leg extending from the chock guides and the pistons are fixed to an end face of the box slides.

5. The improvement according to claim 1 in which a simple, unique and rugged device is provided to effect the axial shifting of work rolls in the rolling mill, wherein the chock guides are manufactured from a single forging that is machined.

6. The improvement according to claim 1, wherein the chock guides contain cylinders for balance/bending cylinders.

* * * * *